US007972144B2

(12) United States Patent
Chang et al.

(10) Patent No.: US 7,972,144 B2
(45) Date of Patent: Jul. 5, 2011

(54) ELECTRICAL CONTACT HAVING ADDITIONAL MOUNTING FEET ARRANGED TO ENSURE RELIABLE ELECTRICAL CONNECTIONS WITH CONDUCTIVE PAD AROUND VIA OF CIRCUIT BOARD

(75) Inventors: Chun-Yi Chang, Tu-Cheng (TW); Jia-Hau Liu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/549,396

(22) Filed: Aug. 28, 2009

(65) Prior Publication Data

US 2010/0055944 A1 Mar. 4, 2010

(30) Foreign Application Priority Data

Sep. 1, 2008 (TW) ..... 97215667 U

(51) Int. Cl.
*H01R 24/00* (2006.01)

(52) U.S. Cl. ..... 439/66; 439/83

(58) Field of Classification Search ..... 439/66, 439/83, 82, 74, 65
See application file for complete search history.

(56) References Cited

U.S. PATENT DOCUMENTS

| | | | | |
|---|---|---|---|---|
| 2003/0082932 | A1 * | 5/2003 | Keyser | 439/66 |
| 2005/0009380 | A1 * | 1/2005 | Brown et al. | 439/66 |
| 2008/0050940 | A1 * | 2/2008 | Lin et al. | 439/66 |
| 2009/0035995 | A1 * | 2/2009 | Chang et al. | 439/630 |
| 2009/0253287 | A1 * | 10/2009 | Polnyi et al. | 439/331 |
| 2009/0325406 | A1 * | 12/2009 | Kojima | 439/82 |

* cited by examiner

*Primary Examiner* — Hien Vu
(74) *Attorney, Agent, or Firm* — Andrew C. Cheng; Wei Te Chung; Ming Chieh Chang

(57) ABSTRACT

A contact (1) for an electrical connector mountable on a substrate (3) having at least a via (311) therethrough comprises a medial portion (10), a contact engaging portion (121) extending from the medial portion (10), a solder terminal portion extending from the medial portion (10) in a direction away from said contact engaging portion (121) and includes at least a first spring arm (11) having a standing point (111), and at least an auxiliary foot (112) extending sideway from the first spring arm (11) having a distance with respect to the standing point (111), the contact engaging portion (121) is adapted to engage with a mating contact.

10 Claims, 3 Drawing Sheets

ELECTRICAL CONTACT HAVING ADDITIONAL MOUNTING FEET ARRANGED TO ENSURE RELIABLE ELECTRICAL CONNECTIONS WITH CONDUCTIVE PAD AROUND VIA OF CIRCUIT BOARD

BACKGROUND OF THE INVENTION

1. Field of the Invention

The present invention relates to an electrical contact, and more particularly to an electrical contact having additional mounting feet arranged to ensure reliable electrical connections with conductive pad around via of a circuit board.

2. Description of the Prior Art

A conventional electrical connector is for electrically connecting a CPU with a PCB, the electrical connector comprises an insulative housing and a plurality of contacts received in the insulative housing. The insulative housing is configured to a rectangular shape and comprises a top surface for supporting the CPU and a bottom surface opposite to the top surface. The contact comprises a base portion, a first spring arm extending upwardly from the base portion and a second base portion extending downwardly from the base portion. The first spring arm defines a first contact portion extending beyond the top surface to connect with the pad of the CPU and the second spring arm defines a second contact portion extending beyond the bottom surface to connect with the pad of the PCB. Thus, it makes a good connection between the CPU and the PCB.

The pad of the PCB defines a hole and the contact portion of the contact often falls into the hole, thus the contact portion can not connect with the pad of the PCB. Thus, the CPU and the PCB is disconnected.

In view of the above, a new electrical connector assembly that overcomes the above-mentioned disadvantages is desired.

SUMMARY OF THE INVENTION

Accordingly, an object of the present invention is to provide an electrical connector having an improved contact with two contact portions to provide a good electrical connection between the contact and the PCB.

To fulfill the above-mentioned object, a contact for an electrical connector mountable on a substrate having at least a via therethrough comprises a medial portion, a contact engaging portion extending from the medial portion, a solder terminal portion extending from the medial portion in a direction away from said contact engaging portion and includes at least a first spring arm having a standing point, and at least an auxiliary foot extending sideway from the first spring arm having a distance with respect to the standing point, the contact engaging portion is adapted to engage with a mating contact.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
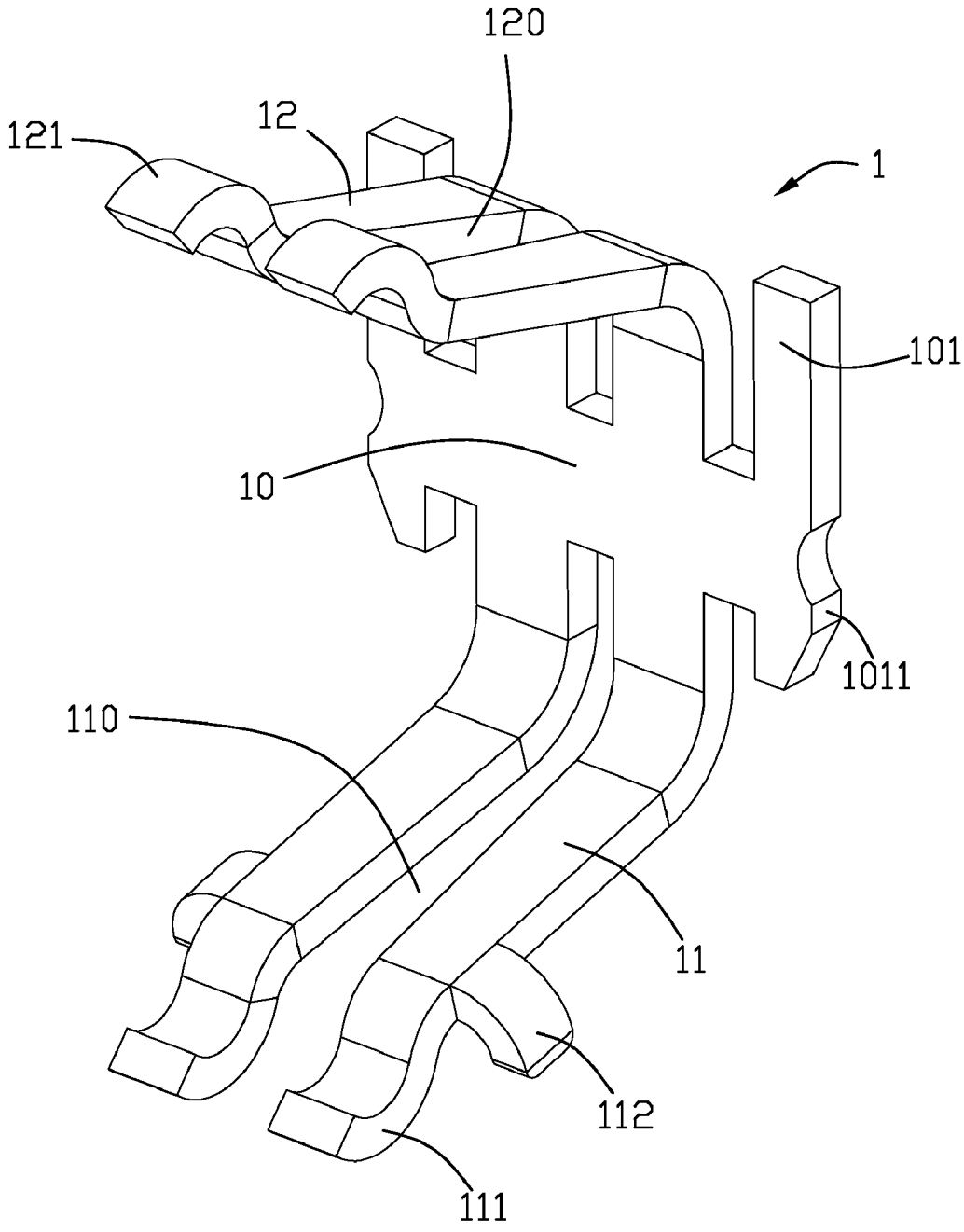
FIG. 1 is an isometric view of an electrical contact in accordance with the preferred embodiment of the present invention.
Figure 2:
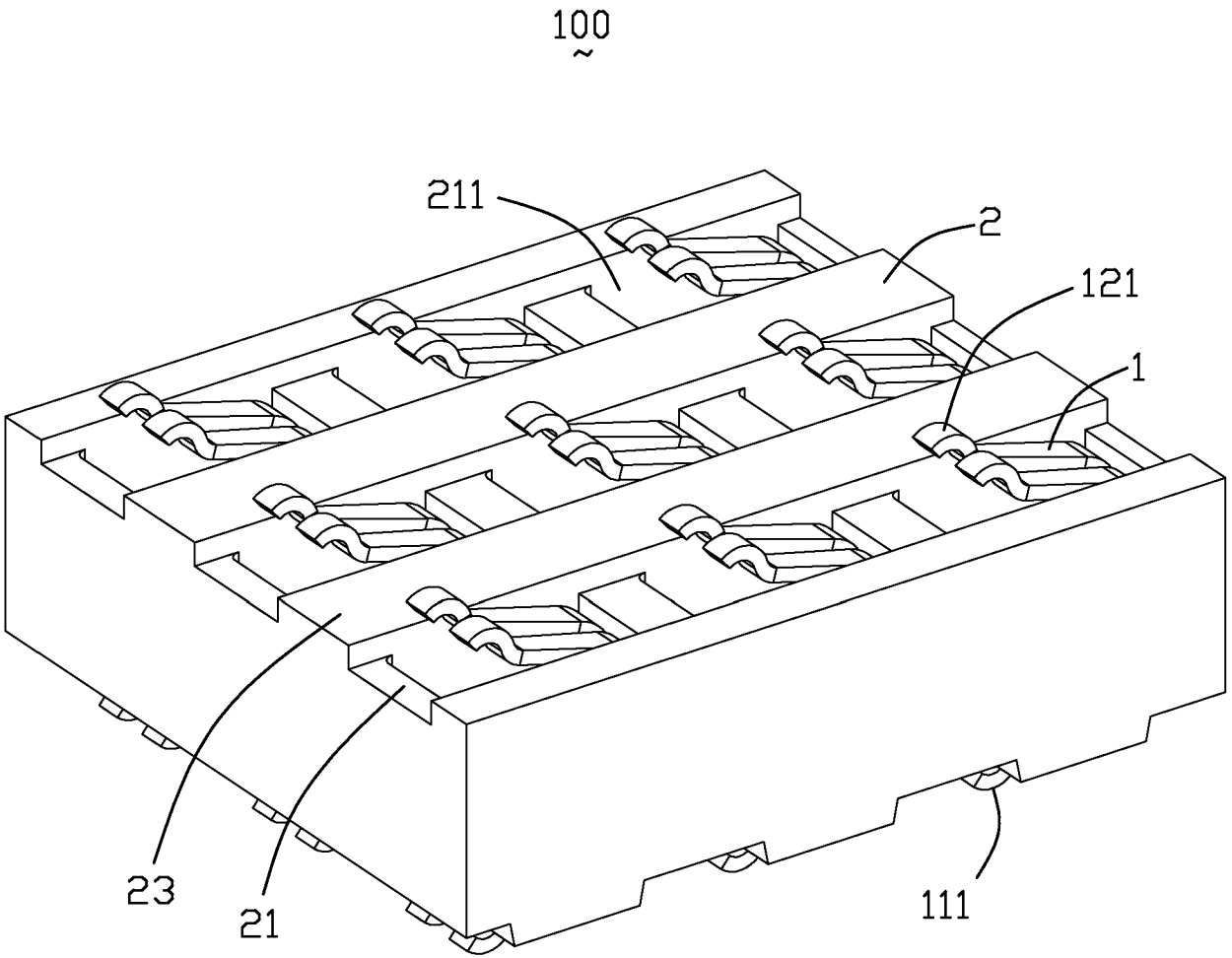
FIG. 2 is an isometric view of an electrical contact in accordance with the preferred embodiment of the present invention.
Figure 3:
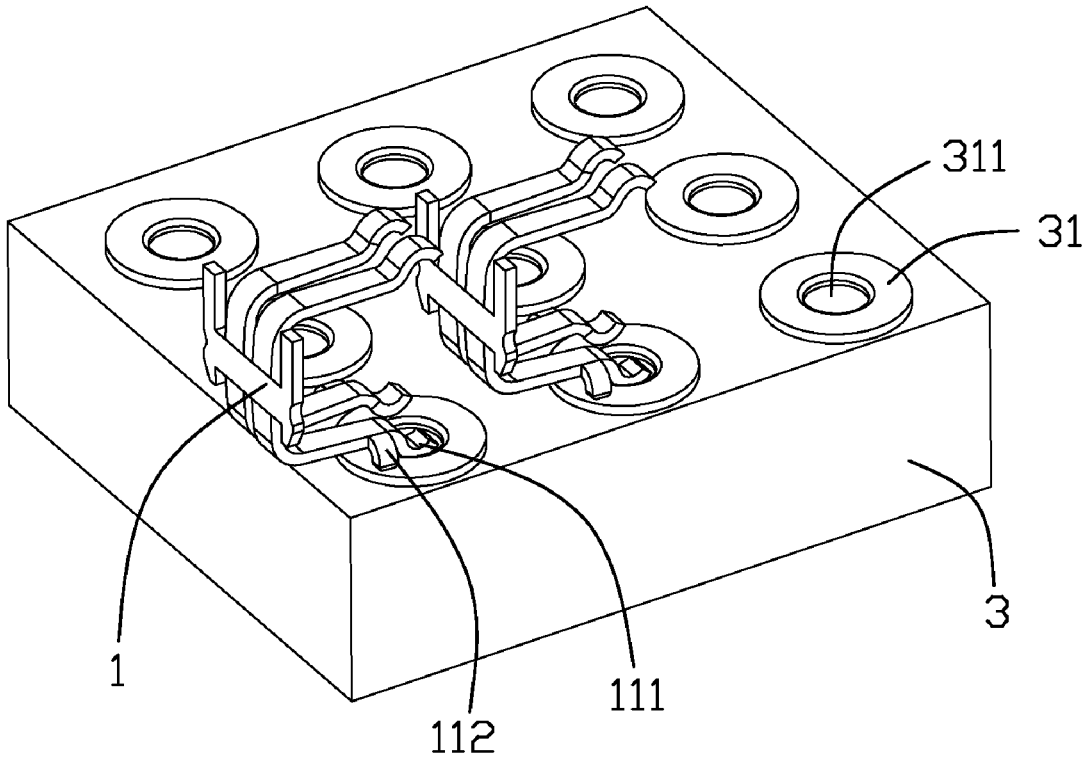
FIG. 3 is an assembly view of the contact and the PCB, showing the foot is connected with the pad of the PCB when the standing point is trapped in the via.

Referring to FIGS. 1-3, an electrical connector 100 in accordance with the present invention is used for electrically connecting an electronic package, such as a land grid array (LGA) central processing unit (CPU) (not shown), with a circuit substrate, such as a PCB 3. The electrical connector comprises an insulative housing 2 with a plurality of contacts 1 received therein. The PCB comprises a plurality of pads 31 and each pad 31 defines a via 311 in the middle thereof.

The insulative housing 2 is configured to a rectangular shape and comprises a top surface 21 and a bottom surface 22 opposite to the top surface 21. The top surface 21 defines a plurality of passageways 211 penetrate to the bottom surface 22 of the insulative housing 2 for receiving the contacts 1 and also defines a plurality of protruding portions 23 extending upwardly. The protruding portions 23 are located between the two adjacent rows of passageways 211. The protruding portions 23 are used to support the CPU and the bottom surface 22 confronts the PCB 3.

The contact 1 has a flat medial portion 10, a pair of fasten portions 101 located on opposite ends of the medial portion 10, a pair of first spring arms 11 extending downwardly and curvedly from the medial portion 10 and a pair of second spring arms 12 extending upwardly and curvedly from the medial portion 10. The fasten portions 101 extending upwardly from the body portion 10 and each has a barb 1011. The pair of first spring arms 11 are paralleled with each other and there is a first slot 110 between the two first spring arms 11, the pair of second spring arms 12 are paralleled with each other and there is a second slot 120 between the two second spring arms 12. The first length of the first slot 110 is equal to the length of the first spring arms 11 and the length of the second slot 120 is equal to the length of the second spring arms 12. The first spring arms 11 each includes a standing point 111 at bottom end thereof and the second spring arms 12 each defines an engaging portion 121 at top end thereof There is an auxiliary foot 112 extending outwardly and downwardly from the first spring arm 11. The foot 112 and the standing point 111 are close to each other and extending in different directions. Each first spring arm 11 has a distal end region to contact the conductive pad 31. A width of the distal end region is smaller than a diameter of the hole 311. The auxiliary foot 112 cooperates with the distal end region to form a bifurcate structure for preventing the distal end region of the spring arms 11 from being significantly trapped in the hole 311.

The standing point 111 and the foot 112 are both projected out of the bottom surface 22 of the insulative housing 2, the engaging portion 121 is projected out of the upper surface of the protruding portions 23. When the electrical connector 100 is used to connect the CPU with the PCB 3, the standing point 111 and the auxiliary foot 112 will not simultaneously trapped in the via 311. Thus, when the standing point 111 is disconnected with the pad 31 of the PCB 3, the foot 112 can ensure a good connection with the pad 31 of the PCB 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A contact for an electrical connector mountable on a substrate having at least a conductive pad defining a hole extending therethrough, comprising:

a medial portion;

a pair of first spring arms extending from the medial portion and each having a solder terminal having a standing point at a bottom end thereof;

a pair of second spring arms extending from the medial portion in a direction away from said first spring arms and each having a contact engaging portion~said contact engaging portion being adapted to engage a mating contact; and at least an auxiliary foot extending sideway from a substantial end of each of the first spring arm and having a distance with respect to the standing point such that at least one of the standing point and the auxiliary foot is seated onto the corresponding conductive pad.

2. The contact as claimed in claim 1, wherein the engaging portion is located at the end of the second spring arm.

3. The contact as claimed in claim 1, wherein there is a first slot between the two first spring arms.

4. The contact as claimed in claim 3, wherein the length of the first slot is substantially equal to the length of the first spring arms.

5. The contact as claimed in claim 1, wherein there is a second slot between the two second spring arms.

6. The contact as claimed in claim 5, wherein the length of the second slot is substantially equal to the length of the first spring arms.

7. An electrical connector assembly comprising:

a printed circuit board having thereon a conductive pad having a hole extends extending through the conductive pad and further through the printed circuit board;

an electrical connector mounted upon the printed circuit board and having therein at least one contact which defines a pair of spaced spring arms essentially in a closely parallel relation with each other under condition that a downward contact point of each of said spring arms is arranged to contact the conductive pad and a width of said the downward contact point is smaller than a diameter of the hole; and an auxiliary foot laterally extending from a side edge of the distal end region of each of said spring arms so as to enlarge a lateral dimension thereof, thus preventing said distal end region of said at least one the downward contact point of the spring arms from being significantly trapped in the hole by having at least the other one of the downward contact point is seated upon the corresponding conductive pad.

8. The electrical connector assembly as claimed in claim 7, wherein said auxiliary foot downwardly extends with a tip thereof.

9. The electrical connector assembly as claimed in claim 7, wherein said lateral dimension of the distal end region around the auxiliary foot is larger than any other portions of said at least spring arm.

10. The electrical connector assembly as claimed in claim 9, wherein said auxiliary foot extends downwardly with a tip being essentially coplanar with said downward contact point for contacting the conductive pad.

* * * * *